US006579163B1

(12) United States Patent
Ross et al.

(10) Patent No.: US 6,579,163 B1
(45) Date of Patent: Jun. 17, 2003

(54) BLADE SHARPENING ASSEMBLY

(75) Inventors: Glenn D. Ross, Marietta, GA (US); Peter N. Lalos, Gaithersburg, MD (US)

(73) Assignee: Frost Cutlery Company, Chattanooga, TN (US)

( * ) Notice: Subject to any disclaimer, the term of this patent is extended or adjusted under 35 U.S.C. 154(b) by 514 days.

(21) Appl. No.: 08/607,549

(22) Filed: Feb. 27, 1996

Related U.S. Application Data

(63) Continuation of application No. 08/292,857, filed on Aug. 19, 1994, now abandoned.

(51) Int. Cl.[7] ..... B24B 33/00
(52) U.S. Cl. ..... 451/545; 451/540
(58) Field of Search ..... 403/353, 354; 451/371, 175, 557, 162, 524, 558, 367, 540, 545; 269/3, 71, 97; 76/82

(56) References Cited

U.S. PATENT DOCUMENTS 1,904,075 A * 4/1933 Petrich ..... 451/175
4,142,809 A * 3/1979 Shell ..... 403/353
4,216,627 A * 8/1980 Westrom ..... 451/175
4,320,892 A * 3/1982 Longbrake ..... 451/175
4,404,873 A * 9/1983 Radish ..... 451/371
4,441,279 A * 4/1984 Storm et al. ..... 451/371
4,486,982 A * 12/1984 Longbrake ..... 451/174
4,512,112 A * 4/1985 LeVine ..... 451/175
4,714,239 A * 12/1987 LeVine ..... 269/3
4,777,770 A * 10/1988 LeVine ..... 451/557
5,138,801 A * 8/1992 Anthon et al. ..... 451/367
5,363,602 A * 11/1994 Anthon et al. ..... 451/367

* cited by examiner

*Primary Examiner*—Derris H. Banks
(74) *Attorney, Agent, or Firm*—Blank Rome LLP

(57) ABSTRACT

A blade sharpening assembly generally consisting of a support member having a first opening and at least a second opening spaced from the first opening, a blade holding assembly including a first member having a projecting section receivable in the first opening and cooperable with a portion of the support member for detachably securing the blade holding assembly in supported relation on the support member, a second member pivotally connected to the first member and means for pivoting one of the blade members relative to the other blade member about a fulcrum point to cause opposed end portions of the blade members to converge and engage a blade disposed therebetween in clamping relation, and a sharpening member including a sharpening stone engageable with a blade clamped between the blade holding sections, a longitudinally projecting guide rod receivable within the second opening in the support member and a gripping section which may be gripped to move the sharpening member with a reciprocating motion when the sharpening stone engages the blade and the guide rod is received within the second opening of the support member.

29 Claims, 3 Drawing Sheets

BLADE SHARPENING ASSEMBLY

This is a continuation of application Ser. No. 08/292,857 filed on Aug. 19, 1994, now abandoned.

BACKGROUND OF INVENTION

This invention relates to an assembly for sharpening blades and more particularly to such an assembly of the type including a blade holding device and a sharpening member cooperable with the blade holding device for guiding a sharpening stone of the sharpening member across an edge of a blade held by the holding device.

In the prior art, there has been developed a type of blade sharpening assembly which basically includes a blade holding device and a sharpening member cooperable with the holding device to sharpen an edge of a blade held by the holding device. The holding device typically has consisted of a pair of blade holding members or jaws pivotally connected together at a fulcrum point, means for angularly displacing one set of ends of the blade holding members about the fulcrum point to correspondingly angularly displace an opposite set of ends of such holding members for clamping a blade therebetween, and a guide post usually connected to or formed integrally with one of the blade holding members, provided with a plurality of spaced openings. The sharpening member typically has consisted of a gripping portion having a sharpening stone disposed on an underside thereof and engageable with an edge of a blade held by the blade holding members, when in use, and a longitudinally disposed rod portion adapted to be received in a selected opening of the guide post for guiding the sharpening member as the sharpening stone portion thereof is moved in a reciprocating motion across the blade edge. Examples of such type of blade sharpening device are disclosed in U.S. Pat. Nos. 4,320,892 and 4,486,982 to Howard F. Longbrake, U.S. Pat. Nos. 4,512,112, 4,714,239 and 4,777,770 to Arthur L. LeVine and U.S. Pat. No. 5,138,801 to John R. Anthon et al.

In each of such type of blade holding device, it has been found that the design thereof has been unduly complicated resulting in high manufacturing costs, awkward and difficult assembly and disassembly of the components of the device and unsatisfactory use of the device. It thus has further been found to be desirable to provide an improved blade sharpening device of the type described, obviating the various design flaws attendant to prior art blade sharpening devices.

Accordingly, it is the principal object of the present invention to provide an improved assembly for sharpening blades.

Another object of the present invention is to provide a blade sharpening assembly of the type utilizing a blade holding device provided with a guide post and a sharpening device provided with a gripping portion, a sharpening stone disposed on an underside of the gripping portion thereof and engageable with an edge of a blade held by the blade holding assembly, and a longitudinally disposed rod portion receivable within a selected opening of the guide post for guiding the sharpening member as the sharpening stone thereof is moved across the edge portion of the blade with a reciprocating motion.

A further object of the present invention is to provide an improved blade sharpening assembly which may be used in either hand held or bench mounted positions.

A still further object of the present invention is to provide an improved blade sharpening assembly which is comparatively simple in design, relatively inexpensive to manufacture, easy to quickly assemble and disassemble and effective in use.

Other objects and advantages of the present invention will become more apparent to those persons having ordinary skill in the art to which the present invention pertains from the following description taken in conjunction with the accompanying drawings wherein:

DETAILED DESCRIPTION

Figure 4:
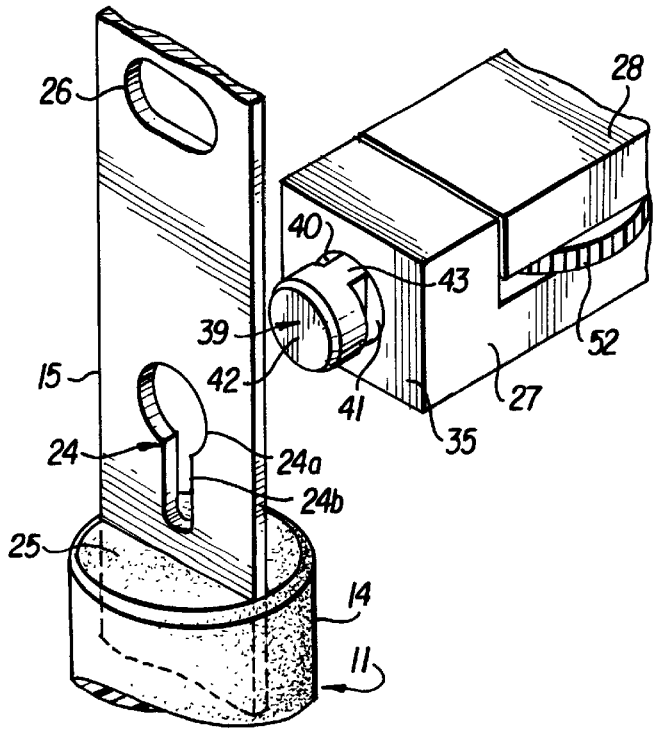
FIG. 4 is an enlarged perspective view of a portion of the assembly shown in FIG. 1, illustrating several components thereof in exploded relation.
Figure 5:
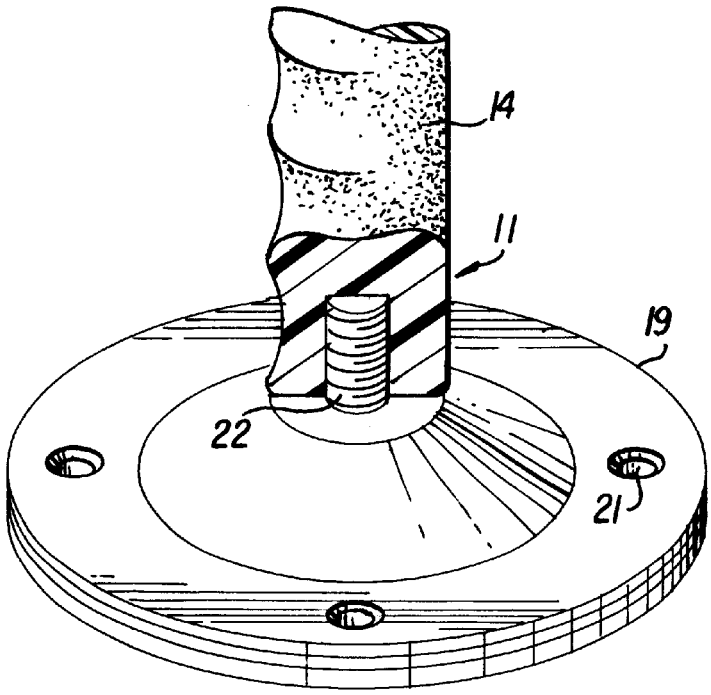
FIG. 5 is a perspective view of a portion of the assembly shown in FIGS. 1 through 3, illustrating the assembly mounted in a fixed position on a support surface.
Figure 6:
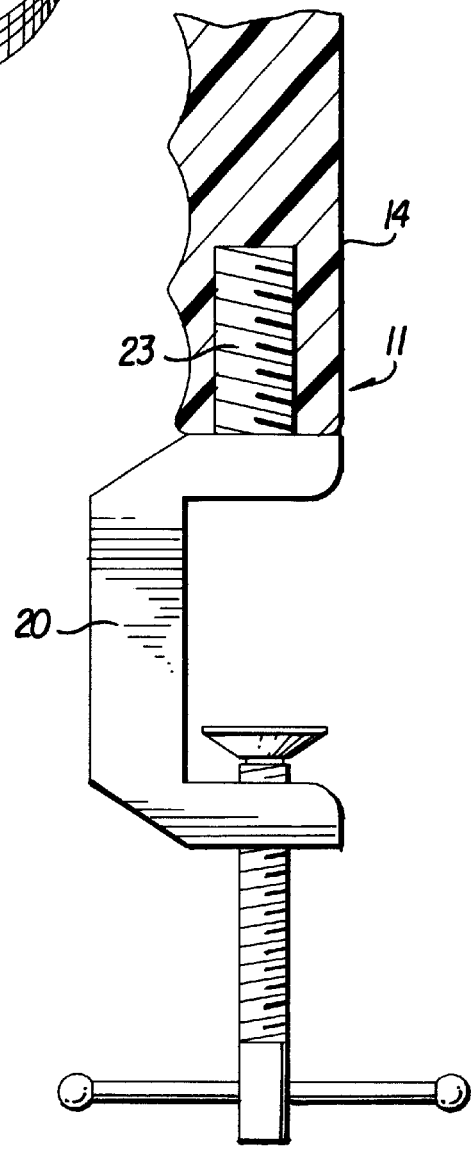
FIG. 6 is a side elevational view of a portion of the assembly shown in FIGS. 1 through 4, provided with a clamping device for supporting the assembly on a ledge or overhanging support member of a table or workbench.

Referring to FIGS. 1 through 4 of the drawings, there is illustrated a blade holding assembly 10 which generally includes a support member 11, a blade holding assembly 12 and a sharpening member 13. The support member includes a hand held base section 14 and a longitudinally disposed guide section 15. Base section 14 has essentially a cylindrical configuration with a diameter suitable for gripping with an average size hand, and a set of depressions 16 along one side thereof for accommodating the fingers of a hand gripping the member. The base section further is provided with an axially disposed, threaded opening 17 in an end surface 18 to permit the support member and correspondingly the entire assembly to be optionately hand held, or be disposed in a fixed position by mounting the support member on a fixed base member 19 as shown in FIG. 5 or a clamp as shown in FIG. 6. The base member shown in FIG. 5 is provided with a plurality of screw holes 21 to permit the member to be rigidly secured to a support surface, and an axially disposed threaded stub portion 22 on which the support member may be threaded and thus fixedly supported. C-clamp 20 is of a conventional type adapted to be secured to a ledge or overhang portion of a table or workbench, and is provided with a threaded stub portion 23 onto which the support member may be threaded to secure the support member and correspondingly the entire assembly onto the C-clamp which may be secured to a selected overhanging member.

Base section 14 may be formed of any material although it is preferred to be made of a molded resin such as an acetal resin sold by E.I. Dupont Demours & Co. under the trademark DELPRIN.

Figure 2:
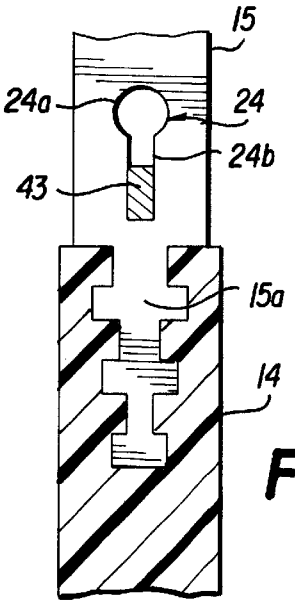
FIG. 2 is an enlarged cross-sectional view taken along line 2—2 of FIG. 1.

Guide section 15 generally consists of an elongated, metallic plate member having an end portion 15*a* embedded in the base section so that the guide section projects longitudinally relative to the base section. The guide section further provides an attachment opening 24 disposed adjacent an end surface 25 of the base section, and a plurality of spaced guide slots 26 spaced from opening 24. As best seen in FIGS. 2 and 4, opening 24 includes a circular portion 24*a* and a slotted portion 24*b* disposed radially relative to portion 24*a* and having a width smaller than the diameter of portion 24*a*, resembling a conventional key hole. Guide slots 26 are elongated transversely relative to the length of section 15 and are spaced different distances from opening 24. Preferably, guide section 15 is formed of a sturdy metallic strip having an irregular end portion 15*a* for securely embedding end portion 15*a* in base section 14 as shown in FIG. 2.

Figure 3:
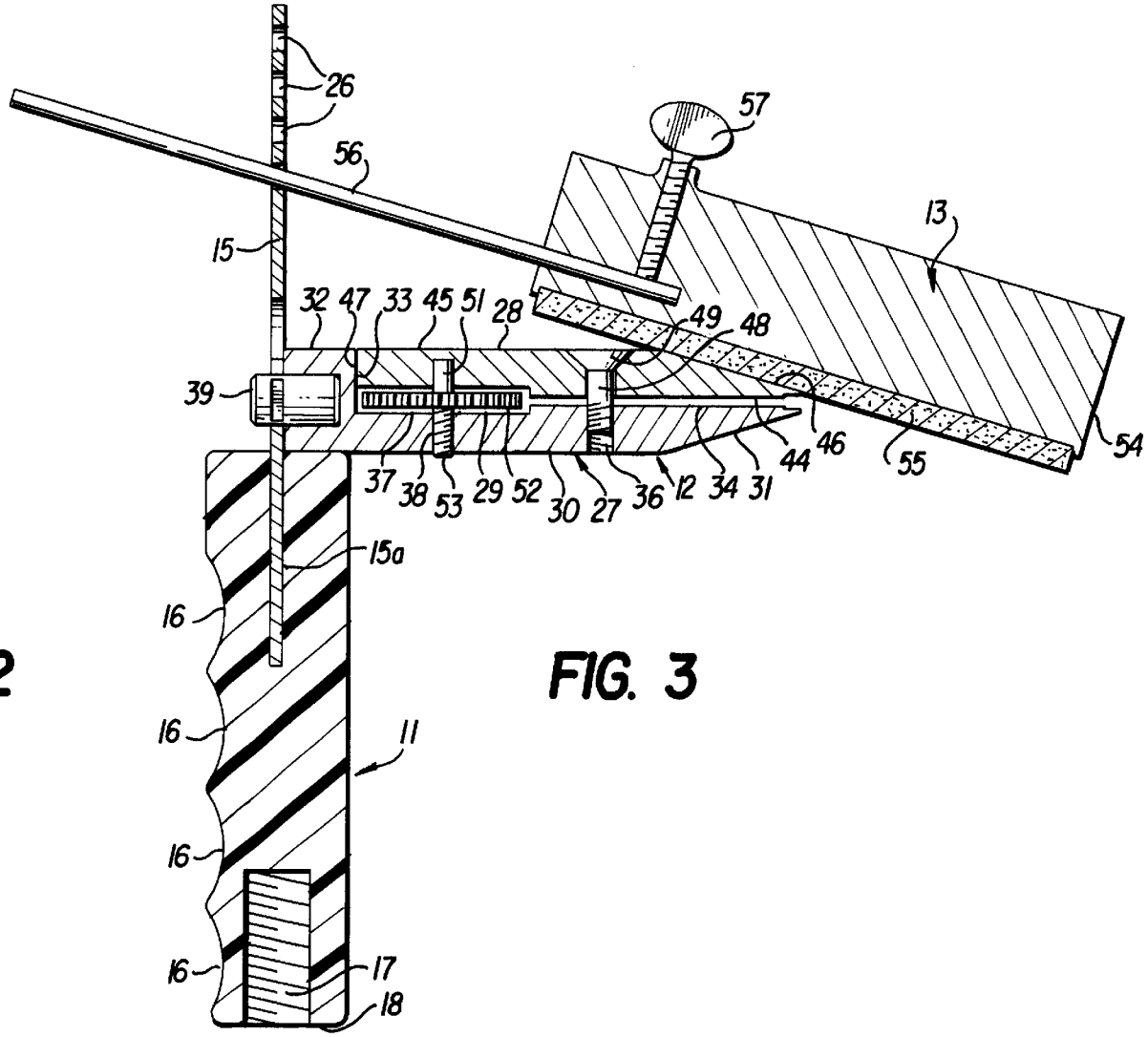
FIG. 3 is an enlarged cross-sectional view taken along line 3—3 in FIG. 1.

Blade holding assembly 12 includes a first blade holding member or jaw 27, a second blade holding member or jaw 28 and an actuating member 29. As best shown in FIGS. 3 and 4, blade holding member 27 includes a lower surface 30 having an angularly disposed portion 31 at a forward end thereof, an upper surface 32 having a cut-out portion providing an end surface 33 and an upper surface 34 disposed parallel with surface 30, a pair of side surfaces and a rear end surface 35. Such member further is provided with a first threaded opening 36 in upper surface 34, and a second threaded opening 38 in a recessed portion 37 in upper surface 34. The member further is provided with a section 39 projecting outwardly from end surface 35 which is adapted to be received through opening 24 in the support member and cooperate with plate section 15 to detachably secure the blade holding assembly to the support member.

As best shown in FIG. 4, projecting section 39 is cylindrically configured and includes a pair of vertically disposed, parallel slots 40 and 41 to provide a head portion 42 and a neck portion 43. Head portion 42 has a diameter slightly less than the diameter of opening portion 24*a* and neck portion 43 has a width slightly less than the width of radially disposed slot 24*b* so that head portion 42 may be easily asserted in an axial direction through opening portion 24*a* to align neck portion 43 with radial slot 24*b*, and the holding assembly may then be displaced downwardly toward base section 14 to insert neck portion 43 in radially disposed slot 24*b*. Under such conditions, the blade holding assembly will be detachably connected to the support member and the blade holding assembly will be prevented from becoming detached by reason of the inner sides of head portion 42 engaging outer surfaces of guide portion 15 disposed along the sides of radially disposed slot 24*b*. The blade holding assembly will not normally be released from the support member unless the assembly is displaced radially relative to opening portion 24*a* to position projecting section 39 axially in opening portion 24*a*, and the assembly is displaced axially relative to opening portion 24*a* to clear projecting portion 39 from guide section 15.

Blade holding member 28 is configured to be received within the cut-out portion of holding member 27 and cooperate therewith to receive and clamp a blade to be sharpened between forwardly disposed ends thereof. The member consists of a lower surface 44 adapted to be disposed in opposed relation to upper surface 34 of member 27, an upper surface 45 disposed parallel to surface 44 and having an angularly disposed forward portion 46, a pair of side surfaces spaced apart the same distance as the side walls of member 27 and a rear wall 47 adapted to be disposed in opposed relation to surface 33 of member 27 when the blade holding members are in the assembled condition. Blade holding member 28 further is provided with a screw opening 48 adapted to receive a flathead screw 49 therethrough and threaded into opening 36 of member 27 to provide a pivotal connection between members 27 and 28 at a fulcrum point, and a recessed portion 50 in bottom surface 44 provided with an opening 51 adapted to be axially aligned with threaded opening 38 when the blade holding members are in the assembled condition as shown in FIG. 3.

Figure 1:
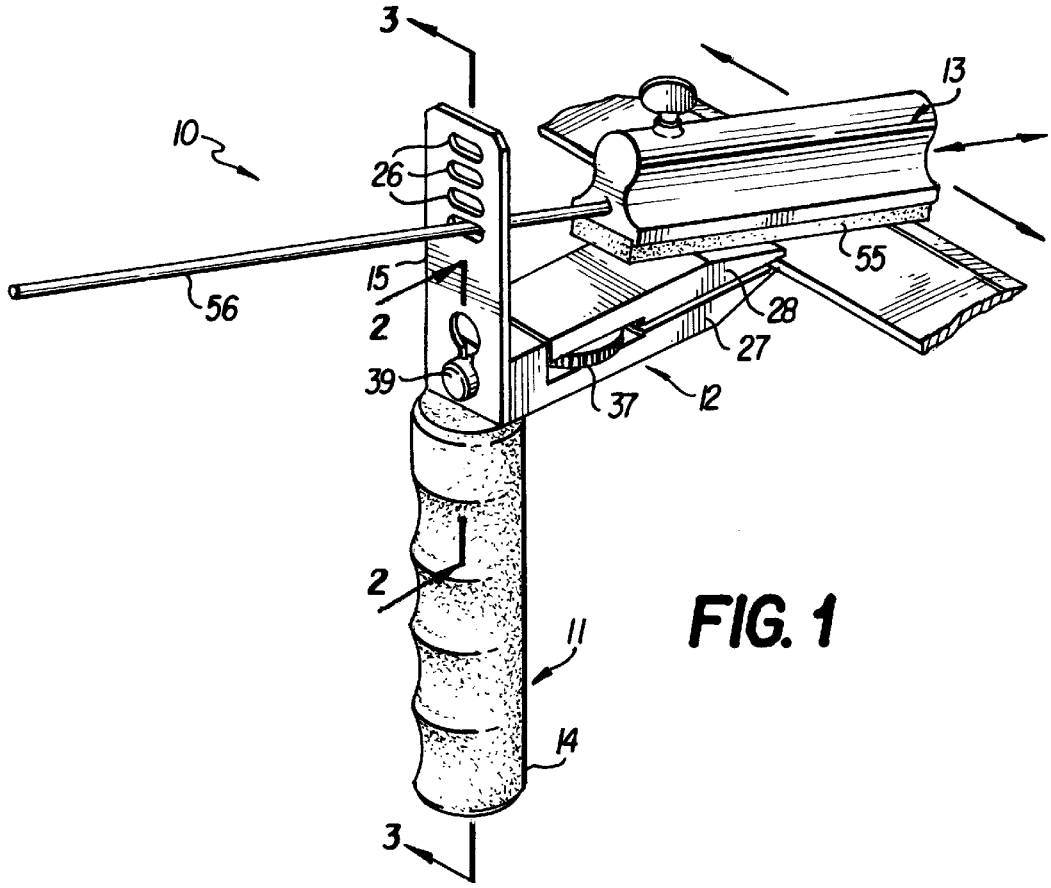
FIG. 1 is a perspective view of a blade sharpening assembly embodying the present invention.

Actuating member 37 includes a wheel section 52 positioned in recessed portions 37 and 52 and having a diameter slightly greater than the width of the blade holding members, as best shown in FIGS. 1 and 4, and an axially disposed pin 53 having a lower threaded end threaded into threaded opening 38 and an opposite end portion received in aligned opening 51 in blade holding member 28 when the blade holding assembly is in the assembled condition. It will be appreciated that by rotating wheel section 52, pin 53 will be caused to be displaced axially and correspondingly cause one set of ends to angularly displace relative to the fulcrum point of the assembly and an opposite set of ends of the members to displace to clamp and unclamp a blade positioned therebetween. The blade holding members and the actuating member therefor may be formed of any suitable, sturdy material although it is preferred that they be formed of a metal of suitable strength.

Sharpening member 13 consists of a hand gripping section 54 having a sharpening stone 55 on an underside thereof and engageable with an edge of a blade held between a forwardly disposed set of ends of the blade holding members, and a longitudinally disposed guide rod 56 which is adapted to be received in a guide opening 26 when the assembly is in use as shown in FIG. 1. The sharpening stone has a generally rectangular configuration, is adhesively or otherwise secured to the underside of gripping section 54 and may consist of any suitable abrasive material for sharpening a blade edge. Guide rod 56 consists of a rigid material, preferably a metal, having an inner end thereof received within a longitudinally disposed opening in gripping section 54 and detachably secured therein by means of a thumb screw 57.

In the use of the blade holding assembly shown in FIGS. 1 through 4 without the use of a mounting device, the blade holding assembly is grasped in the palm of one hand and wheel 52 may be rotated with the thumb and forefinger to space the set of outer ends of the holding members apart. The blade to be sharpened may then be inserted with the other hand between the spaced apart ends of the holding members and positioned in place while the wheel may be rotated in the opposite direction to clamp the blade between the outer ends of the blade holding members. By holding the support member in one hand and the blade holding assembly with the blade clamped therein in the other hand, the blade holding assembly may be attached to the support member by inserting projecting section 39 into opening portion 24*a* of the guide section of the support member, and sliding it downwardly so that neck portion 43 of section 39 is received in radially disposed slot 24*b*. With the blade holding assembly thus secured to the support member, the assembly may be released with the one hand and the sharpening member may be grasped and placed in position by inserting guide rod 56 in a guide opening 26 and resting the sharpening stone on the blade edge to be sharpened. Then, while continuing to hold the support member by the base section with one hand, the main body of the sharpening member may be moved with a reciprocating motion forwardly and rearwardly and from side to side to sharpen the blade edge. To adjust the position of the blade relative to the blade holding assembly, it is required only to conveniently grasp and rotate wheel section 52 to displace the set of forward ends of the holding members to release the blade, reposition the blade and then move the holding members together by rotating the wheel in the opposite direction to reclamp the blade in the adjusted position.

In circumstances where it is desired to use the assembly by mounting it on a support structure, the support member may be rigidly mounted on such a support structure by the use of a base member 19 or a clamp assembly 20. In either instance, the assembly may be used by threading the lower end of the support member onto a threaded stud 22 of the base member or 23 of the C-clamp assembly, attaching the blade holding assembly to the support member as previously described, manipulating the blade holding assembly to position and clamp the blade to be sharpened between the members thereof similarly in the manner as previously described, and then positioning and moving the sharpening member in the manner described to sharpen the blade edge.

The blade sharpening assembly as described provides a number of advantages over various prior art blade sharpening devices. Whenever one side of a blade secured in the clamp assembly has been sharpened and it is desired to sharpen the opposite side of the blade, all that is required to be done to reposition the blade is to slide the clamp assembly upwardly to position projecting section 39 in opening portion 24*a*, rotate the clamp assembly 180° to position neck portion 43 of the projecting section in vertical alignment with slot 24*b* and lower the clamp assembly so that neck portion 43 again is received within slot 24*b*. Such maneuver may be done simply and quickly to accurately position the blade for sharpening the reverse side thereof. Another advantage of the present invention is that when the clamping assembly is in the operative condition as shown in FIGS. 1 through 3, the engagement of neck portion 43 with the side edges of slot 24*b* prevents the clamp assembly from rotating about the axis of projecting section 39. Furthermore, as best illustrated in FIG. 3, when the clamping assembly is mounted on the support member with neck portion 43 of projecting section 39 received within slot 24*b*, a portion of lower surface 30 of blade member 27 will be seated on upper surface 25 of the support member to enhance the rigidity and stability of the assembled components when the assembly is in use and a downward force is applied to the clamping assembly as the sharpening member is pressed downwardly onto the blade being sharpened.

The simple design and configuration of each of the several components of the blade sharpening assembly as described permits the positioning of such components in a compact container for storage and other purposes. The components can be arranged and sold in a kit compactly positioned in a case for readily handling and storing such components.

From the foregoing detailed description, it will be evident that there are a number of changes, adaptations and modifications of the present invention which come within the province of those persons having ordinary skill in the art to which the aforementioned invention pertains. However, it is intended that all such variations not departing from the spirit of the invention be considered as within the scope thereof as limited solely by the appended claims.

We claim:

1. A blade sharpening assembly comprising:

a support means for supporting a blade holding assembly, said support means having a first opening and at least a second opening spaced from said first opening;

a blade holding assembly including a first blade holding member having a projecting section receivable in said first opening of said support means and cooperable with a portion of said support means for detachably securing said blade holding assembly in supported relation on said support means, said projecting section being displaceable between first and second positions in said first opening;

said support means having non-obstructing surfaces permitting longitudinal displacement of said projecting section into said first opening in said first position and out of said first opening and rotational displacement of said projecting section relative to a longitudinally disposed axis when said projecting section is disposed in said first position, and obstructing surfaces precluding longitudinal displacement of said projecting section and rotational displacement of said projecting section relative to a longitudinally disposed axis when said protecting section is disposed in said second position;

a second blade holding member pivotally connected to said first blade holding member about a fulcrum point, and means for pivoting one of said blade members relative to the other of said blade holding members about said fulcrum point to cause opposed end blade portions of said blade holding members to displace and engage a blade disposed therebetween in clamping relation; and a sharpening member including a sharpening stone engageable with a blade clamped between said blade holding members, a longitudinally projecting guide rod receivable in said second opening in said support means, and a gripping section coupled to said sharpening stone, which may be gripped to move said sharpening member with a reciprocating motion while said sharpening stone engages said blade and said guide rod is received within said second opening of said support means.

2. An assembly according to claim 1 wherein said support means includes a hand gripping section.

3. An assembly according to claim 1 including a base member mountable on a support structure, and means for detachably mounting said support means on said base member.

4. An assembly according to claim 3 wherein said means for detachably mounting said support means to said base member comprises a threaded connection.

5. An assembly according to claim 1 including a C-clamp assembly mountable on a support structure, and means for detachably mounting said support means on said C-clamp assembly.

6. An assembly according to claim 5 wherein said means for detachably mounting said support means on said C-clamp assembly comprises a threaded connection.

7. An assembly according to claim 1 wherein said support means includes a plurality of spaced openings for selectively receiving said guide rod of said sharpening member therethrough.

8. An assembly according to claim 1 wherein said first opening in said support means includes a first portion for receiving a leading portion of said projecting section of said first blade holding member therethrough, and a second restricted portion for receiving therein a trailing, reduced portion of said projecting section after said leading portion of said projecting section of said first blade holding member is received through said first portion of said first opening.

9. An assembly according to claim 8 wherein said first portion of said first opening is substantially circular and said second restricted portion of said first opening comprises a slot in a lower part of said first portion of said first opening.

10. An assembly according to claim 8 wherein said leading portion of said projecting section of said first blade holding member comprises a head portion and said trailing, reduced portion of said projecting section includes a neck portion.

11. An assembly according to claim 1 wherein said means for pivoting said blade holding members about said fulcrum point comprises a shaft interposed between two end portions of said blade holding members, having one end thereof threaded into an opening of one of said blade holding members and another end thereof bearing against the other of said blade holding members, and a wheel which may be gripped and rotated to cause the displacement of the ends of said blade holding members relative to each other and correspondingly cause the displacement of the other ends of said blade holding members relative to each other for clamping and unclamping a blade disposed between said other ends of said blade holding members.

12. An assembly according to claim 11 wherein said wheel is disposed between said blade holding members and has a diameter greater than the width of said blade holding members.

13. An assembly according to claim 11 wherein said wheel is disposed in recessed portions of opposed surfaces of said blade holding members.

14. An assembly according to claim 11 wherein said blade holding members include end portions, between which a blade may be received and clamped, said end portions having outer converging surfaces.

15. An assembly according to claim 1 wherein said first blade holding member includes an inner surface having a recessed portion and an outer surface, said second blade holding member includes an inner surface having a recessed portion and an outer surface, and said pivoting means includes a wheel disposed in said recessed portions of said blade holding members, having a diameter greater than the width of said blade holding members and an axially disposed shaft having one end portion threaded into a threaded opening in one of said blade holding members and another end portion engageable with the other of said blade holding members whereby upon rotation of said wheel, a first set of ends of said blade members will be angularly displaced relative to said fulcrum point to correspondingly angularly displace a second set of ends of said blade holding members relative to said fulcrum point to selectively displace said second set of ends of said blade holding members into clamping and unclamped relation with a blade disposed therebetween.

16. In a blade sharpening assembly including a blade holding assembly and a blade sharpening member, a support means for supporting said blade holding assembly comprising:

an elongated member having a first opening therein for receiving a projecting section of said blade holding assembly therein in detachably securing relation, and at least a second opening therein for receiving a guide rod of said blade sharpening member therethrough when said projection section of said blade holding assembly is received within said first opening and said blade holding assembly is detachably secured to said elongated member, and a sharpening stone section of said sharpening member is engaged with a blade held by said blade holding assembly.

17. A support means according to claim 16 wherein said elongated member includes a hand gripping section.

18. A support means according to claim 16 wherein said elongated member includes means for securing the elongated member to a base member by a threaded connection.

19. A support means according to claim 16 wherein said first opening includes a first portion adapted to receive a leading portion of said projecting section of said blade holding assembly, and a second portion adapted to receive a trailing reduced portion of said projecting section when said leading portion of said projection section is received through said first opening portion.

20. A support means according to claim 19 wherein said first portion of said first opening is circular for receiving a head portion of said projecting section of said blade holding assembly, and said second portion of said first opening comprises a slot in a lower end of said first opening portion for receiving a neck portion of said projecting section of said blade holding assembly.

21. A support means according to claim 16 wherein said elongated member includes a plurality of openings spaced from said first opening for selectively receiving said guide rod of said blade sharpening member.

22. In a blade sharpening assembly including a support means for supporting a blade holding assembly and a blade sharpening member, a blade holding assembly comprising:

a first blade holding member having a projecting section receivable in an opening in said support means and cooperable with a portion of said support means for detachably securing said first member in supported relation with said support means;

a second blade holding member pivotally connected to said first blade holding member for pivotal movement relative thereto about a fulcrum point; and means for pivotally displacing one set of ends of said first and second blade holding members about said fulcrum point to cause an opposite set of ends thereof to pivotally displace relative to said fulcrum point for clamping and unclamping a blade disposed between said opposite set of ends of said first and second blade holding members.

23. An assembly according to claim 22 wherein said projecting section of said first blade holding member includes a leading portion receivable within a first portion of said opening in said support means and a trailing portion receivable in a second portion of said opening more restricted than said first portion of said opening, when said leading portion of said projecting section is received in said first portion of said opening.

24. An assembly according to claim 23 wherein said leading portion of said projecting section of said first blade holding member comprises a head portion and said trailing portion of said projecting section comprises a neck portion.

25. An assembly according to claim 22 wherein said means for pivoting said blade holding members about said fulcrum point comprises a shaft interposed between two end portions of said blade holding members, having one end thereof threaded into an opening of one of said blade holding members and another end thereof bearing against the other of said blade holding members, and a wheel which may be gripped and rotated to cause said shaft to displace axially and correspondingly displace the ends of said blade holding members relative to each other and cause the displacement of the other ends of said blade holding members relative to each other for clamping and unclamping a blade disposed between said other ends of said blade holding members.

26. An assembly according to claim 25 wherein said wheel is disposed between said blade holding members and has a diameter greater than the width of said blade holding members.

27. An assembly according to claim 25 wherein said wheel is disposed in recess portions of opposed surfaces of said blade holding members.

28. An assembly according to claim 22 wherein said blade holding members include ends, between which a blade may be clamped, said ends having outer converging surfaces.

29. An assembly according to claim 22 wherein said first blade holding member includes an inner surface having a recessed portion and an outer surface, said second blade holding member includes an inner surface having a recessed portion and an outer surface, and said pivoting means includes a wheel disposed in said recessed portions of said blade holding members, having a diameter greater than the width of said blade holding members and an axially disposed shaft having one end portion thereof threaded into a threaded opening in one of said blade holding members and another end portion engageable with the other of said blade holding members whereby upon rotating said wheel, a first set of ends of said blade holding members will be angularly displaced relative to said fulcrum point to correspondingly angularly displace a second set of ends of said blade holding members relative to said fulcrum point to selectively displace said second set of ends of said blade holding members into clamping and unclamped relation with a blade disposed therebetween.

* * * * *